US010401113B2

(12) United States Patent
Schärer

(10) Patent No.: US 10,401,113 B2
(45) Date of Patent: Sep. 3, 2019

(54) MUZZLE DEVICE FOR A PROJECTILE-FIRING DEVICE

(71) Applicant: Christian Schärer, Kandersteg (CH)

(72) Inventor: Christian Schärer, Kandersteg (CH)

( * ) Notice: Subject to any disclaimer, the term of this patent is extended or adjusted under 35 U.S.C. 154(b) by 40 days.

(21) Appl. No.: 15/742,216

(22) PCT Filed: Jul. 8, 2016

(86) PCT No.: PCT/CH2016/000102
§ 371 (c)(1),
(2) Date: Jan. 5, 2018

(87) PCT Pub. No.: WO2017/004728
PCT Pub. Date: Jan. 12, 2017

(65) Prior Publication Data

US 2019/0086174 A1 Mar. 21, 2019

(30) Foreign Application Priority Data

Jul. 9, 2015 (CH) ..... 996/15

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/38
USPC ..... 89/14.3, 177, 198
See application file for complete search history.

(56) References Cited

U.S. PATENT DOCUMENTS 1,342,978 A * 6/1920 Young ..... F41A 21/30 181/223
1,877,118 A * 9/1932 Barnes ..... F41A 25/02 126/41 R
1,901,138 A * 3/1933 Barnes ..... F41A 21/30 89/14.3

(Continued)

FOREIGN PATENT DOCUMENTS

CH 46859 5/1910

*Primary Examiner* — Samir Abdosh
(74) *Attorney, Agent, or Firm* — Duane Morris LLP; J. Rodman Steele, Jr.; Gregory M. Lefkowitz

(57) ABSTRACT

Muzzle device for a projectile-firing device, comprising:—a body adapted to be fixed at a muzzle of a projectile firing device and comprising an axial passageway for permitting the passage of a projectile leaving said muzzle along an axis in a forwards direction and at least one lateral port having an inner end opening into said passageway and an outer end opening at an outer surface of said body, said lateral port having a proximal wall and a distal wall, said proximal wall being situated closer to said muzzle than said distal wall, wherein said distal wall comprises, considered in a plane containing said axis and a midline of said lateral port:—a first distal wall portion having a concave cross-section;—a second distal wall portion adjacent to said first distal wall portion and having a convex cross-section;—a third distal wall portion adjacent to said second distal wall portion and having a concave cross-section; and—a fourth distal wall portion adjacent to said third distal wall portion and having a convex cross-section, said fourth distal wall portion terminating at said outer surface of said body at an acute angle thereto.

16 Claims, 5 Drawing Sheets

(56) References Cited

U.S. PATENT DOCUMENTS

| | | | | |
|---|---|---|---|---|
| 1,948,496 | A * | 2/1934 | Barnes | F41A 21/36<br>89/14.3 |
| 2,143,596 | A | 1/1939 | Galliot et al. | |
| 2,212,685 | A * | 8/1940 | Hughes | F41A 21/36<br>89/14.3 |
| 2,223,014 | A | 11/1940 | Galliot et al. | |
| 5,333,529 | A * | 8/1994 | Brockman | F41A 21/38<br>42/79 |
| 7,600,461 | B1 * | 10/2009 | Cler | F41A 21/36<br>89/14.3 |
| 2015/0308778 | A1 * | 10/2015 | Vossler | F41A 21/36<br>89/14.3 |
| 2017/0191782 | A1 * | 7/2017 | Bray | F41A 21/36 |
| 2019/0017770 | A1 * | 1/2019 | Lake | F41A 21/28 |
| 2019/0086174 | A1 * | 3/2019 | Scharer | F41A 21/36 |

* cited by examiner

MUZZLE DEVICE FOR A PROJECTILE-FIRING DEVICE

CROSS-REFERENCE TO RELATED APPLICATIONS

This application is a § 371 national stage entry of International Application No. PCT/CH2016/000102, filed Jul. 8, 2016, which claims priority to Swiss European Patent Application No. 996/15, filed Jul. 9, 2015, the entire contents of which are incorporated herein by reference.

TECHNICAL FIELD

The present invention relates to the field of projectile-firing devices such as firearms, shotguns, artillery, airguns, softair, cannon and so on. More particularly, it relates to a muzzle brake and/or a compensator for reducing recoil by redirecting propellant gases at the muzzle after the projectile has exited.

STATE OF THE ART

Experimentation with muzzle brakes and compensators for reducing the felt recoil of firearms has had a long history, dating back over 100 years. Typically, such devices comprise a tube adapted to be fitted to the muzzle of a firearm with a passage for the passage of the projectile (or projectiles in the case of a shotgun) and at least one baffle arranged to direct a portion of the expanding propellant gases leaving the muzzle in a sideways, upwards, and/or rearwards direction, or any combination thereof. An early example is disclosed in the document CH19001, dating from the end of the 19th century, which discloses several variants of such muzzle devices and illustrates several of the problems associated therewith. In a first variant, the tube is perforated and a series of tronconical washers are fitted therein, with the apex of the tronconical washer being directed towards the muzzle. A portion of the expanding propellant gases are thus redirected in an oblique lateral direction, and thus apply a reaction force to the baffles which serves to push the muzzle device, and hence the firearm to which it is attached, forwards against its recoil force. However, such tronconical baffles are inefficient and do not extract as much work from the expanding gases as possible. In a second variant, the baffles are concave when viewed from the muzzle, and serve to direct a portion of the expanding gases rearwards, thereby extracting more work from them, generating more reaction force, and reducing recoil to a greater extent than in the first variant.

However, this improved recoil reduction comes at the price of increased noise, since the expanding gases are directed towards the user of the firearm and towards any other persons adjacent to him.

9A third variant seeks to reduce the noise by surrounding the baffles with a chamber, which opens rearwards via several holes. This reduces noise, but also reduces the recoil reduction since the efficiency of the device is reduced.

In the intervening century, many further types of muzzle brakes and compensators have been developed, however excellent recoil reduction has always had to be traded off against increased noise, and various unsatisfactory compromises have been reached to try and achieve a muzzle brake and/or compensator with good recoil reduction, low noise increase, and low bulk. In essence, the better the noise performance, the worse the recoil performance. Such problems have prevented widespread acceptance of such muzzle devices in hunting and in Western militaries, where hearing protection is often not used and thus increased noise over a plain muzzle is undesirable.

An object of the present invention is thus to propose a muzzle device offering low bulk, good recoil reduction, and yet low noise increase compared to a plain muzzle.

DISCLOSURE OF THE INVENTION

This aim is attained by a muzzle device for a projectile-firing device, comprising a body adapted to be fixed at a muzzle of a projectile firing device of any type. The muzzle device comprises art axial passageway for permitting the passage of a projectile leaving said muzzle along an axis in a forwards direction and at least one lateral port having an inner end opening into said passageway and an outer end opening at an outer surface of said body. The lateral port has a proximal wall and a distal wall, said proximal wall being situated closer to said muzzle than said distal wall.

According to the invention, the distal wall comprises, considered in a plane containing said axis and a midline of said lateral port:

- a first distal wall portion having a concave cross-section;
- a second distal wall portion adjacent to said first distal wall portion and having a convex cross-section;
- a third distal wall portion adjacent to said second distal wall portion and having a concave cross-section; and
- a fourth distal wall portion adjacent to said third distal wall portion and having a convex cross-section and terminating at said outer surface of said body at an acute angle thereto.

The first portion of the distal wall, being concave, thus serves to redirect expanding propellant gases with a rearward component, generating thereby a reaction force. The second portion, being concave, serves to redirect the gases onto the third portion. Since the third portion is again concave, further reaction force is generated. The final, fourth portion being convex and making an acute angle with the outer surface of the body, the propellant gases are thus vented with a forward component, away from the user. As a result, the recoil reduction properties of the muzzle device are excellent due to the presence of two concave portions on the distal wall of the port serving to generate a large reaction force, and the noise performance is also excellent due to the forward venting.

Advantageously, the proximal wall comprises, considered in a plane containing said axis and a midline of said lateral port:

- a first proximal wall portion having a convex cross-section facing the first portion of the distal wall;
- a second proximal wall portion adjacent to said first proximal wall portion and having a concave cross section facing the second distal wall portion;
- a third proximal wall portion adjacent to said second proximal wall portion and having a convex cross-section facing the third distal wall portion; and
- a fourth proximal wall portion having a concave cross-section facing the third distal wall portion and terminating at said outer surface of said body at an acute angle thereto.

The form of each portion of the proximal wall is complementary to that of the corresponding portion of the distal wall, which further serves to help guide the expanding propellant gases. In particular, the angle which the fourth portion of the proximal wall makes with the outer surface helps in directing blast away from the user and from any persons standing beside him.

Advantageously, the height of said proximal wall and of said distal wall considered perpendicular to said plane containing said axis and a midline of said lateral port increases towards said outer surface. This permits the expanding propellant gases to expand in the vertical direction so as to exit the port at a lower pressure. As a result, the useful work extracted from the gases is primarily extracted in the first section of the port containing the first portion of the distal wall at a higher pressure, and the gases are vented forward out of the device at a much lower pressure, reducing the rearward reaction caused by the fourth section of the port and reducing the blast and noise.

Advantageously, the first distal wall portion meets said axial passageway at a right angle, considered in said plane.

The muzzle device may also comprise a second lateral port arranged symmetrically to said at least one lateral port, i.e. in a diametrically-opposite direction, and at least one further lateral port may be arranged in a line with said at least one lateral port.

Advantageously, the fourth portion of the proximal wall makes an angle of 35 to 55 degrees with said axis, and wherein said fourth portion of said distal wall makes an angle of 25 to 45 degrees with said axis. This provides good forward venting, but also good shielding for the user and any bystanders.

Advantageously, the muzzle device further comprises an adaptor arranged to permit attachment of a sound moderator extending over the muzzle device such that said port opens into said sound moderator. The muzzle device may also comprise the sound moderator attached thereupon, in combination.

Advantageously, the muzzle device further comprises at least one air inlet port joining said outer surface to at least one of said lateral ports, said air inlet port being angled such that it meets said outer surface at an angle comprising a component in a direction opposite to said forwards direction. In other words, the gas inlet port opens rearwards. By sizing and angling the port appropriately, upon firing, relatively cool air is sucked into the gas inlet port, mixing with the propellant gases, cooling them and adding air thereto, reducing muzzle flash. Naturally, a plurality of such air inlet ports can be provided, arranged as appropriate and associated with as many lateral ports as desired.

Advantageously, the muzzle device further comprises at least one gas bleed hole, ideally a plurality thereof situated in at least one linear group, joining said axial passageway to said outer surface. These gas bleed holes can be angled such that it meets said outer surface adjacent to a lateral port (9) on a proximal side thereof (i.e. upstream thereof, towards the muzzle to which the device is attached) at an angle comprising a component in said forwards direction. In other words, the one or more gas bleed holes vents forwards, away from the muzzle. In the case of linear groups of gas bleed holes, the gas bleed holes of each group advantageously extend in a plane, each linear group being situated adjacent to a corresponding lateral port. These holes, particularly when optimally sized (0.65-0.85 mm has proven to provide excellent results), allow propellant gas to escape upstream of the adjacent lateral port, disrupting the supersonic shock-wave produced at this latter upon firing. This reduced propagation of the shock wave in the direction of the user, further reducing noise for the user.

Finally, the invention relates to a projectile firing device as defined above comprising a muzzle device according to any of the above-mentioned embodiments.

Figure 1:
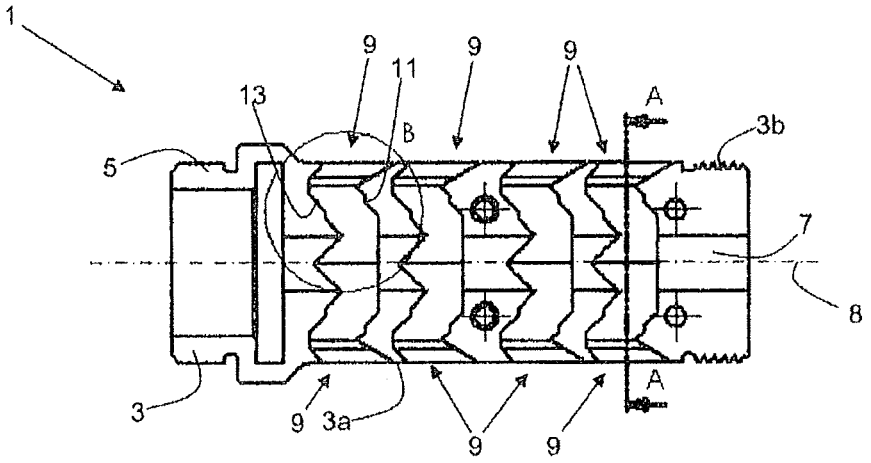
Figure 2:
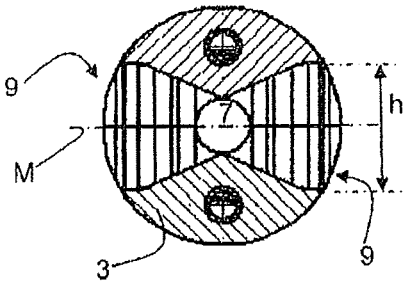
Figure 3:
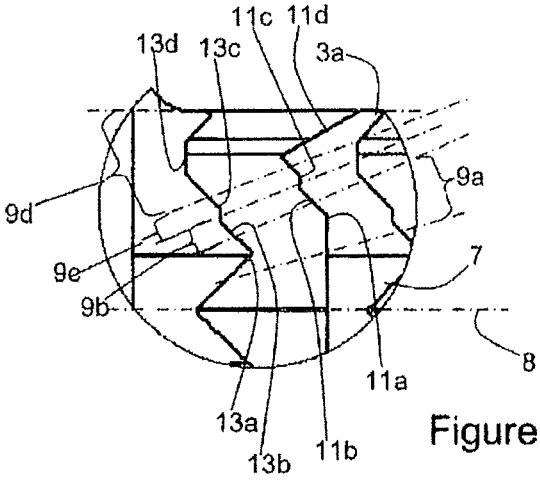
Figure 4:
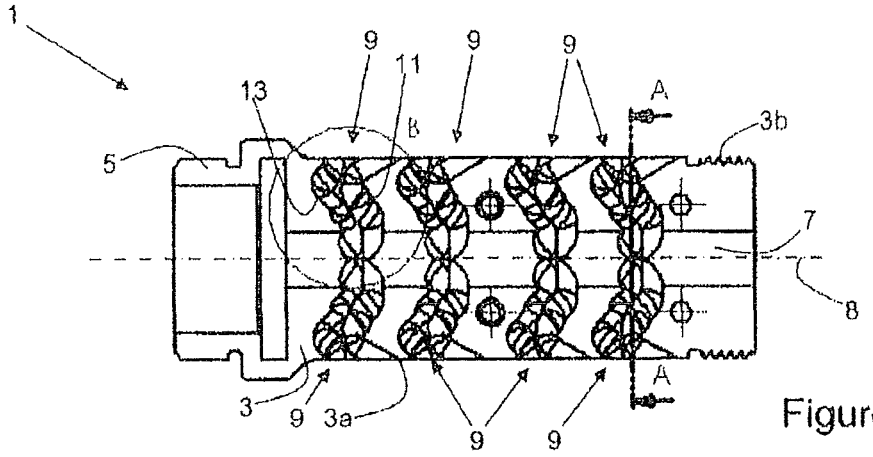
Figure 5:
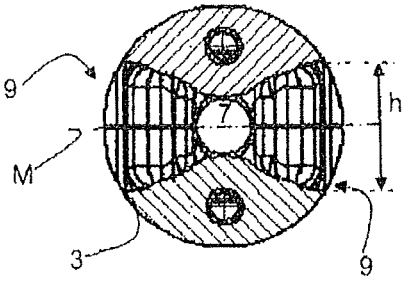
Figure 6:
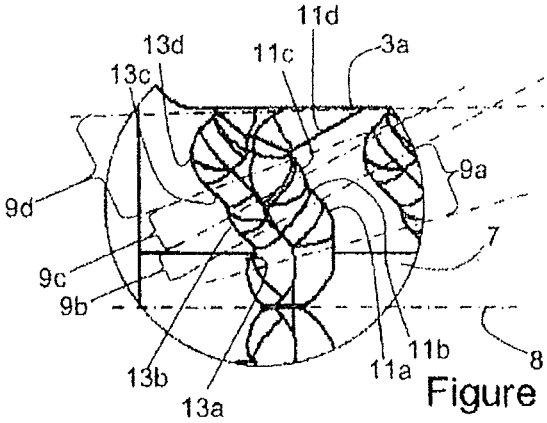
Figure 7:
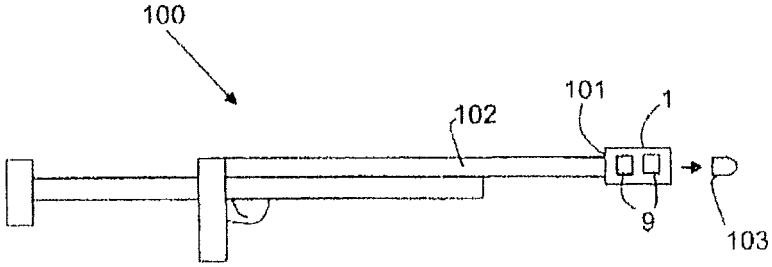
Figure 8:
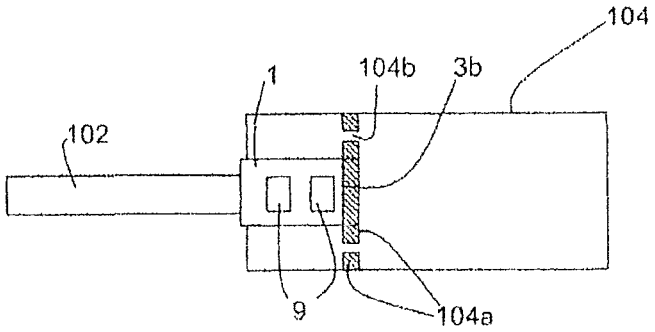
Figure 9:
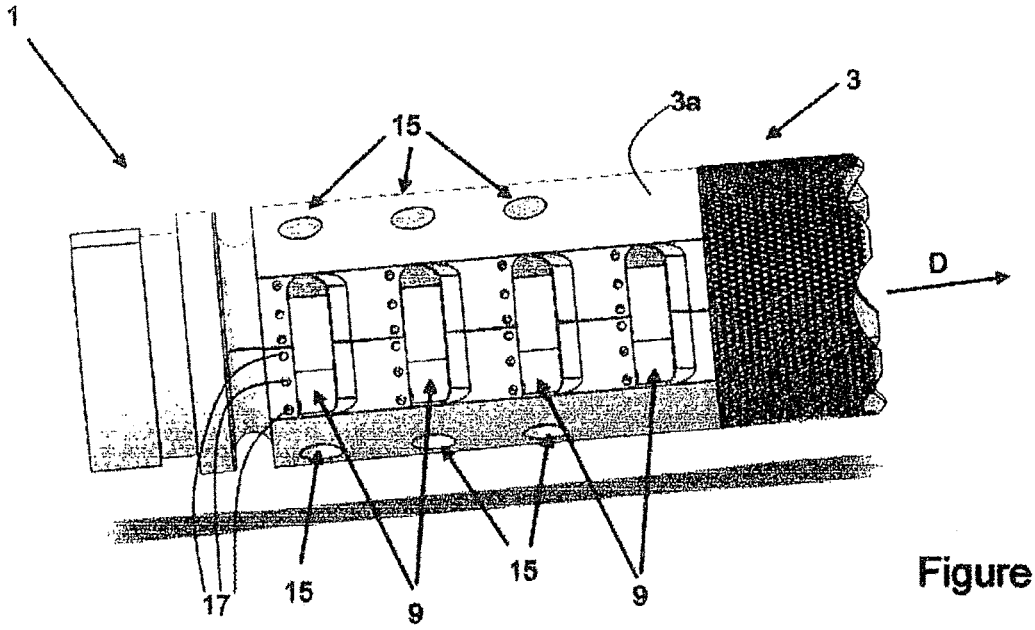
Figure 10:
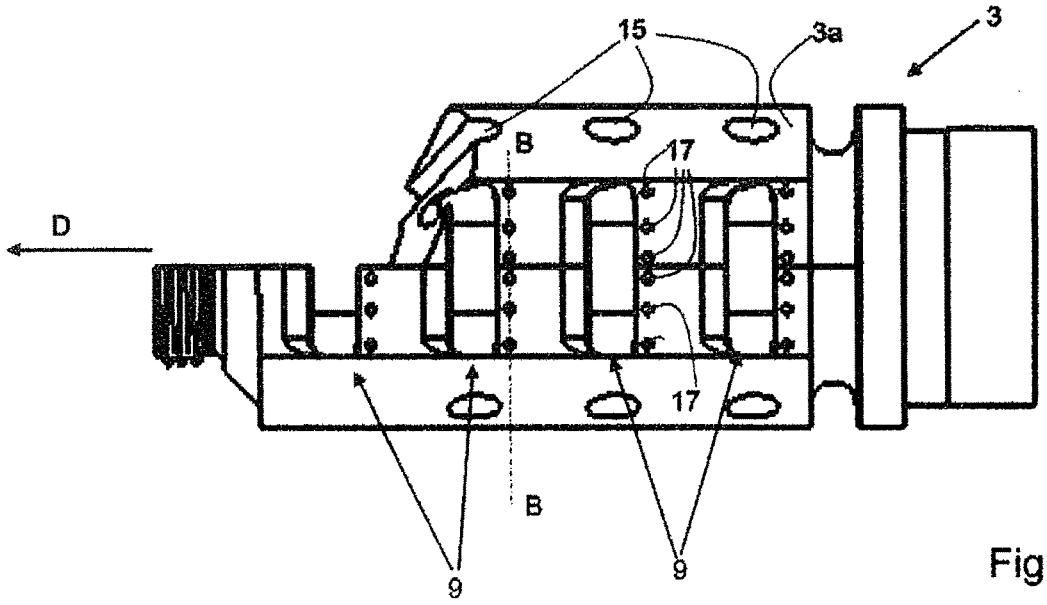
Figure 11:
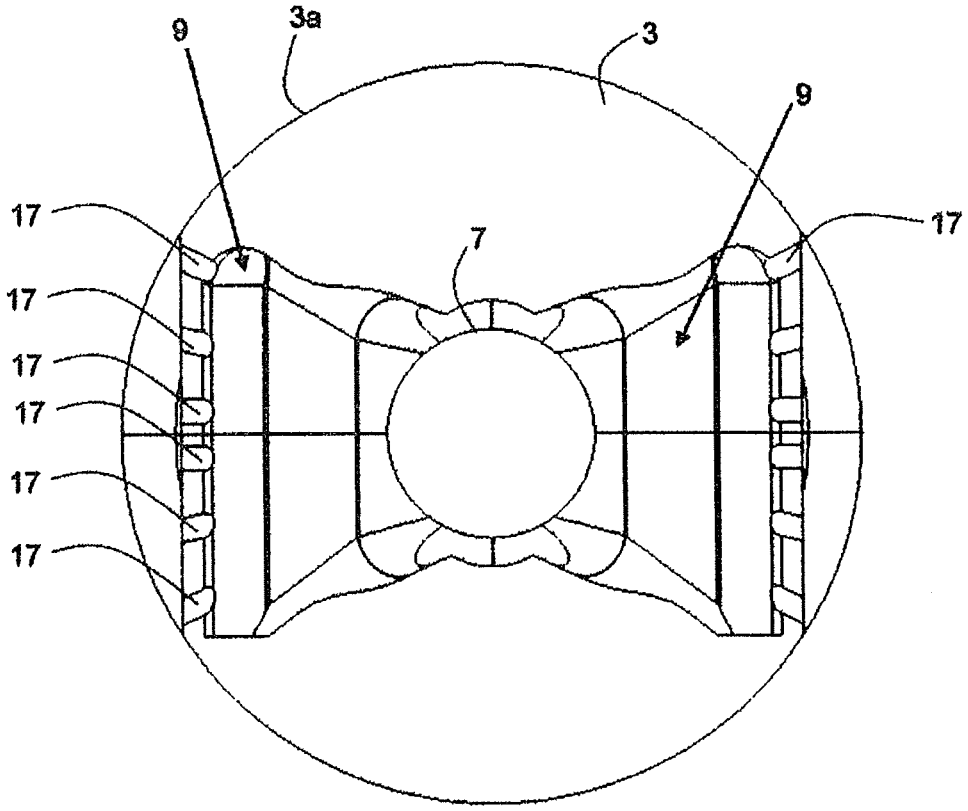

Further details of the invention will appear more clearly upon reading the following description with reference to the appended figures, which show:

FIG. 1: a cutaway view of a first variant of a muzzle device according to the invention taken in a plane containing a midline of the ports;

FIG. 2: a cutaway view along the line A-A of FIG. 1;

FIG. 3: a detail view of the circle B of FIG. 1;

FIG. 4: a cutaway view of a second variant of a muzzle device according to the invention taken in a plane containing a midline of the ports;

FIG. 5: a cutaway view along the line A-A of FIG. 4;

FIG. 6: a detail view of the circle B of FIG. 4;

FIG. 7: a schematic view of the muzzle device of the invention mounted on a rifle;

FIG. 8: a schematic view of the muzzle device of the invention mounted on a barrel and combined with a sound moderator;

FIG. 9: a perspective view of a further embodiment of a muzzle device according to the invention;

FIG. 10: a partially cut-away side elevation view of the muzzle device of FIG. 9;

FIG. 11: a diametric cross-section view of the muzzle device of FIG. 9; and

EMBODIMENTS OF THE INVENTION

FIGS. 1-3 and 4-6 illustrate respectively a first and a second embodiment of a muzzle device 1 according to the invention, the difference between the two variants being that the form of the passageway is highly angular in the first embodiment, and more rounded in the second embodiment for ease of machining. Indeed, FIG. 1-3 show the basic geometric form which rounded to form that of FIGS. 4-6. FIG. 7 illustrates schematically the muzzle device 1 attached to a projectile-firing device 100 such as a rifle, and FIG. 8 shows it combined with a sound moderator.

Muzzle device 1 comprises, as is generally known, a body 3 of typically cylindrical or prismatic form. At a proximal end 5, the body 3 is adapted to be mounted on the muzzle 101 of a barrel 102 of a projectile-firing device 100 such as a rifle, shotgun, artillery piece, airgun, handgun, cannon or similar, either directly by threading or pinning, or indirectly by means of an appropriate adaptor. It may also be integrally formed with the barrel, or welded thereto.

Body 3 also comprises at least one lateral port 9. As illustrated, eight lateral ports 9 are provided, arranged symmetrically in pairs either side of longitudinal axis 8. Although all eight ports are illustrated as being identical, this does not have to be the case. Furthermore, the ports can be arranged in any Body 3 comprises an axial passageway 7 for the passage of a projectile 103 such as a bullet, dart, shell, pellet(s) or similar, which is concentric with the bore of the projectile-firing device and sized to allow the unobstructed passage of a projectile 103. Axial passageway 7 extends along a longitudinal axis 8. direction, such as all pointing upwards so as to act as a compensator, or any combination of directions, as it known.

The present invention resides in the shape of the port 9. Contrary to prior art arrangements, port 9 is shaped so as to maximise the work extracted from the expanding propellant gases, whether combustion products of burning propellant powder, compressed air, carbon dioxide, nitrogen, freon or any other propellant gas, while nevertheless venting forwards, away from the user.

For ease of reading, it is presumed that the muzzle device 1 is mounted on the muzzle 101 of a projectile-firing device 1 with the ports aligned symmetrically to the horizontal plane, as shown in FIG. 7. Hence, "vertical" and "lateral" when used in the following description refer to directions within this reference frame. In other words, "lateral" is the direction in which the port extends, and "vertical" is orthogonal both to the muzzle axis and to the lateral direction. Furthermore, "forwards" signifies a direction away from the muzzle 101 parallel to axis 8, and "rearwards" signifies a direction towards the muzzle 101 parallel to axis 8.

Each port 9 is formed as a passageway between a distal wall 11, situated away from the muzzle 101, and a proximal wall 13, situated towards the muzzle. Each of these walls comprises a surface aligned perpendicular to the longitudinal axis, i.e. vertically. Proximal and distal walls 11, 13 are joined by upper and lower surfaces. Any angles or other dimensions are entirely indicative, and are not to be taken as limiting since variations are of course possible.

The port 9 is divided into four sections, distinguished by their curvatures considered in the cross-section of FIGS. 1, 3, 5 and 6. The divisions between these sections are best seen on FIGS. 3 and 6, which are illustrated by means of chain lines. In the embodiment of FIGS. 4-6, the chain lines dividing the sections intersect the points of inflection of the shape of the distal wall 11 and the proximal wall 13. In the embodiment of FIGS. 1-3, since the form is made up of straight lines, the points of inflection have been chosen arbitrarily such that the shape of the corresponding wall is convex on one side, and concave on the other side of the chain lines. As a result, there is no discontinuity in the shape of either wall between each section.

In a first section 9*a* of the port 9, the first portion 11*a* of distal wall 11, i.e. a first distal wall portion 11*a*, immediately adjoining the axial passageway 7 is concave. In the illustrated embodiment, this portion 11*a* joins the axial passageway 7 at a right-angle and continues as a straight line for a certain distance, although it can also adjoin at a different angle, for instance between 60 and 110°. It can also curve immediately, without a straight section. The first portion 11*a* of distal wall 11 then turns or curves approximately 135° in a rearwards direction so as to make an angle of 45° with the axis 8, and thus serves to turn the expanding propellant gases so as to have a sideways and a rearwards component, and thereby to extract a reaction force therefrom.

The first proximal wall portion 13*a* in this first section 9*a* is convex, and thus serves to help direct expanding gases onto the first section of distal wall 11. Furthermore, first proximal wall portion 13*a* terminates this first section 9*a* at an angle of 45° to the axis 8. The bulk of the reaction force applied by the gases to the muzzle device 1 occurs in this section.

Second section 9*b* of the port 9 adjoins the first section 9*a*. In this section, a second distal wall portion 11*b* is convex, and a second proximal wall portion 13*b* is concave, both wall portions 11*b*, 13*b* ending this section in a direction substantially perpendicular to the axis 8. This section 9*b* serves primarily to redirect the flow of gas and rectify it so as to reduce its rearward component, and thus to direct it in a more lateral direction.

Third section 9*c* of the port 9 adjoins the second section 9*b*. In this section, a third distal wall portion 11*c* is again concave, and again terminates at an angle of approximately 45° to the axis 8. And again, a third proximal wall portion 13*c* is convex, and terminates this section 9*c* also at an angle of 45° to the axis 8. This section 9*c* again serves to extract work from the expanding propellant gases. Since the gases were rectified in the second section 9*b*, more work can be extracted from them in third section 9*c*, since they are turned through a greater angle in this section than would otherwise be the case.

Fourth section 9*d* of the port 9 adjoins the third section 9*c*. By this stage, most of the useful work that can be extracted from the expanding propellant gases have been extracted, and finally the gases need to be vented to atmosphere. Hence, in this section 9*d*, a fourth distal wall portion 11*d* is again convex, and terminates at the outer surface 3*a* at a forward angle of 30° to the axis 8. A fourth proximal wall section 13*d* is concave, and terminates at the outer surface 3*a* at a forward angle of 45° to the axis 8. This combination of angles, +/−10° or +/−5°, serves to vent the propellant gases in a forwards direction at as low a pressure as is reasonably possible without directing them towards either the user, or to another person standing adjacent to the user.

Considering now FIGS. 2 and 5, which represent cutaway views along lines A-A of FIGS. 1 and 4 respectively and thus perpendicular to the cutaway views of FIGS. 1 and 4, it can be seen that the height h of ports 9 increases continuously from the passageway 7 to the outer surface 3*a*. Hence, the propellant gases can expand are given ample opportunity to expand perpendicularly to the direction of flow through the port 9 before exiting at the outer surface 3*a*. As illustrated, each half of the body 3 is a mirror image of the other, however if may be advantageous if, for instance, the lower half of the body 3 has a shallower port so as to give the exhausting gases an upwards component.

In essence, the shape of the port 9 permits to extract more reaction force from the gases than is possible with a single curvature or a single slanted port, and permits redirecting the gases to exit in a forward direction and at a lower pressure without engendering an excessive reaction force in a rearward direction.

To permit the use of saboted projectiles 103, the axial passageway 7 may be sized such that the sabot bears thereupon, and may even comprise rifling. In a typical application, however, the passageway 7 is sized to allow the unobstructed passage of the projectile 103, as is generally known.

Body 3 may also be provided with an adaptor 3*b* such as threads, a bayonet mount or any other convenient means for attachment of a sound moderator 104 as illustrated in FIG. 8. Sound moderator 104 is attached to adaptor 3*b* by means of a complementary adaptor 104*a* situated on the inside of the moderator 104 and provided with through-holes 104*b* so as to permit passage of propellant gas therethrough. As illustrated, adaptor 3*b* is situated at a distal end of the muzzle device 1 away from the muzzle 101, however it may be situated anywhere convenient, such as at or near a proximal end thereof. Moderator 104 extends over the muzzle device 1 such that the ports 9 open into the sound moderator 104. Otherwise, sound moderator 104 may be conventional.

FIGS. 9-12 illustrate a variant of a muzzle device 1 according to the invention, which incorporates two further improvements. These improvements can be applied individually or in combination. It should be noted that the form of the lateral ports 9 is unaffected by these further modifications.

The first of these further improvements can be seen clearly in partially cut-away view in FIG. 10. As can clearly be seen, the muzzle device 1 comprises at least one air inlet port 15, leading from the outer surface 3*a* of the body 3 to the interior of at least one lateral port 9. In the illustrated variant, each of the first three lateral ports 9, counting along the forwards direction D, in which the projectile travels, adjoins a pair of air inlet ports 15 situated above the median plane of the body 5, and also adjoins a further pair of inlet ports 15 situated below the median plane of the body 5, for a total of four air inlet ports 15 for each of the first three lateral ports 9.

The air inlet ports 15 are angled such that they open on the outer surface 3*a* of the body 3 in a direction comprising a component in the opposite direction to the direction D, for instance at an angle of 45-65° with respect to the direction D, the air inlet ports 15 of each pair being angled with respect to each other, for instance at an angle of 45-55°. The passage of a projectile and the propellant gases through the muzzle device causes a pressure drop along the air inlet ports 15, which causes relatively cool air (in comparison to the propellant gases) to be drawn in through the air inlet ports 15. This causes the mixture of remaining combustible components in the propellant gases to be cooled and to become more lean, reducing muzzle flash.

In the present example, the air inlet ports 15 are approximately 3 mm in diameter, but the skilled person can adapt this measurement according to his needs. Furthermore, the exact angles of the air inlet ports 15 and the angle between adjacent ports 15 can be adapted according to the needs of the skilled person, to the degree that the angles and dimensions obtain the desired inflow of air.

The second improvement concerns gas bleed holes 17, visible on each of FIGS. 9-12. FIG. 11 is a cross-section view along line B-B of FIG. 10, i.e. along the plane in which the gas bleed holes 17 open, looking in the opposite direction to direction of projectile travel B. These gas bleed holes 17 are arranged in groups and adjoin the axial passageway 7 upstream of each lateral port 9 (although it is possible to only provide them behind one or more lateral ports 9), on a proximal side thereof (i.e. the side closer to the muzzle upon which the device 1 is mounted), and adjoin the outer surface 3*a* of the body 3 at an angle having a component in the direction of projectile travel D, for instance making an angle of 35°-65° therewith. In more general terms, these gas bleed holes 17 vent forwards, away from the user.

The gas bleed holes 17 may have any convenient number (six are illustrated for each series of gas bleed holes in the present example, the holes 17 of each group being situated in a plane in a linear fashion), and may have any convenient angle each with respect to the others. The function of these holes 17 is as follows.

Figure 12:
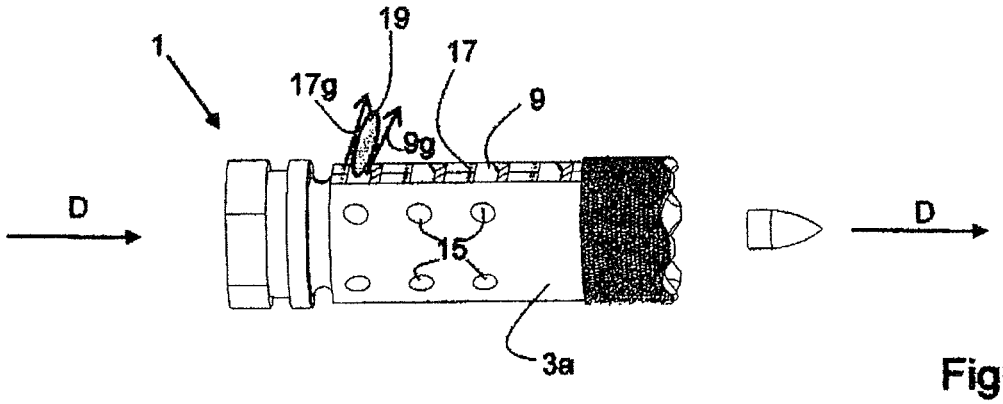
FIG. 12: a view of the muzzle device of FIG. 9 illustrating schematically certain gas flows.

Propellant gas vents through each series of gas bleed holes 17, as illustrated by the arrow 17*g* on FIG. 12, which disrupts the shock wave caused by gas escaping from the immediately-adjacent lateral port 9 (represented by arrow 9*g*). The gas 17*g* exiting the gas bleed holes 17 creates a "curtain" of moving gas, which interrupts the supersonic shock wave 19 created at the adjacent lateral port 9. The propagation of this shock wave in the direction of the user (i.e. in the direction opposite to direction D) is hence minimised. The user is thus exposed to significantly less noise than would otherwise be the case. If the diameter of the gas bleed holes 17 is carefully chosen, the shock wave cannot propagate through the gas bleed holes 17 themselves, maximising this effect.

Experiments have shown that diameters of approximately 0.65-0.85 mm, more ideally 0.7-0.8 mm for the gas bleed holes 17 provide a good optimum for the above-mentioned noise-reduction effect.

To construct the muzzle device 1 according to the invention, conventional machining in two halves split along the plane of FIGS. 1 and 4 followed by assembling with bolts, pins, (laser) welding, or any other convenient means or combination thereof is possible. Alternatively, the muzzle device 1 can be made in a unitary construction by metallic 3D printing, such as DMLS (Direct Metal Laser Sintering) or any other convenient process.

The invention claimed is:

1. Muzzle device for a projectile-firing device, comprising a body adapted to be fixed at a muzzle of a projectile firing device and comprising an axial passageway for permitting the passage of a projectile leaving said muzzle along an axis in a forwards direction and at least one lateral port having an inner end opening into said passageway and an outer end opening at an outer surface of said body, said lateral port having a proximal wall and a distal wall, said proximal wall being situated closer to said muzzle than said distal wall, wherein said distal wall comprises, considered in a plane containing said axis and a midline of said lateral port:

a first distal wall portion having a concave cross-section;

a second distal wall portion adjacent to said first distal wall portion and having a convex cross-section;

a third distal wall portion adjacent to said second distal wall portion and having a concave cross-section; and a fourth distal wall portion adjacent to said third distal wall portion and having a convex cross-section, said fourth distal wall portion terminating at said outer surface of said body at an acute angle thereto.

2. Muzzle device according to claim 1, wherein said proximal wall comprises, considered in a plane containing said axis and a midline of said lateral port:

a first proximal wall portion having a convex cross-section facing the first portion of the distal wall;

a second proximal wall portion adjacent to said first proximal wall portion and having a concave cross section facing the second portion of the distal wall;

a third proximal wall portion adjacent to said second proximal wall portion and having a convex cross-section facing the third portion of the distal wall; and—a fourth proximal wall portion adjacent to said third proximal wall portion having a concave cross-section facing the third distal wall portion and terminating at said outer surface of said body at an acute angle thereto.

3. Muzzle device according to claim 1, wherein the height of said proximal wall and of said distal wall considered perpendicular to said plane containing said axis and said midline of said lateral port increases towards said outer surface.

4. Muzzle device according to claim 1, wherein said first distal wall portion meets said axial passageway at a right angle.

5. Muzzle device according to claim 1, further comprising a second lateral port arranged symmetrically to said at least one lateral port.

6. Muzzle device according to claim 1, further comprising at least one further lateral port arranged in a line with said at least one lateral port.

7. Muzzle device (1) according to claim 2, wherein said fourth proximal wall portion makes an angle of 35 to 55 degrees with said axis, and wherein said fourth distal wall portion makes an angle of 25 to 45 degrees with said axis.

8. Muzzle device according to claim 1, further comprising an adaptor arranged to permit attachment of a sound moderator extending over the muzzle device (1) such that said port opens into said sound moderator.

9. Muzzle device according to claim 8, further comprising a sound moderator extending over the muzzle device such that said port opens into said sound moderator.

10. Muzzle device according to claim 1, further comprising at least one air inlet port joining said outer surface to at least one of said lateral ports, said air inlet port being angled such that it meets said outer surface at an angle comprising a component in a direction opposite to said forwards direction.

11. Muzzle device according to claim 1, further comprising at least one gas bleed hole joining said axial passageway to said outer surface, said gas bleed hole being angled such that it meets said outer surface adjacent to a lateral port on a proximal side thereof at an angle comprising a component in said forwards direction, said at least one gas bleed hole (17) preferably having a diameter in the range 0.65-0.85 mm.

12. Muzzle device according to claim 11, comprising a plurality of said gas bleed holes situated in at least one linear group.

13. Muzzle device according to claim 12, wherein the gas bleed holes of said at least one linear group extend in a plane.

14. Muzzle device according to claim 12, comprising a plurality of said linear groups, each of said linear groups being situated adjacent to a corresponding lateral port.

15. Muzzle device according to claim 13, comprising a plurality of said linear groups, each of said linear groups being situated adjacent to a corresponding lateral port.

16. Projectile firing device comprising a muzzle device according to claim 1.

* * * * *